US007927266B1

(12) United States Patent
Morris

(10) Patent No.: US 7,927,266 B1
(45) Date of Patent: Apr. 19, 2011

(54) TRIGGER FINGER STRENGTHENING APPARATUS AND METHOD

(76) Inventor: Jeffrey Scott Morris, Brunswick, GA (US)

( * ) Notice: Subject to any disclaimer, the term of this patent is extended or adjusted under 35 U.S.C. 154(b) by 0 days.

(21) Appl. No.: 12/259,704

(22) Filed: Oct. 28, 2008

Related U.S. Application Data

(60) Provisional application No. 61/042,813, filed on Apr. 7, 2008.

(51) Int. Cl.
*A63B 21/02* (2006.01)
*A63B 21/05* (2006.01)

(52) U.S. Cl. ..... 482/122; 482/128; 434/16

(58) Field of Classification Search ..... 482/121, 482/122, 128, 148, 47; 42/69.01, 69.02, 42/69.03; 434/16, 17, 18, 19
See application file for complete search history.

(56) References Cited

U.S. PATENT DOCUMENTS

| | | | | |
|---|---|---|---|---|
| 2,984,037 | A * | 5/1961 | Wilhelm | 42/69.03 |
| 3,577,667 | A * | 5/1971 | Kern et al. | 42/69.01 |
| 3,859,977 | A * | 1/1975 | Lange | 124/66 |
| 4,361,072 | A * | 11/1982 | Karlsen | 89/154 |
| 5,012,604 | A * | 5/1991 | Rogers | 42/69.03 |
| 5,052,141 | A * | 10/1991 | Sammons | 42/69.01 |
| 5,074,190 | A * | 12/1991 | Troncoso | 89/136 |
| 5,105,570 | A * | 4/1992 | Lishness et al. | 42/69.01 |
| 5,722,193 | A * | 3/1998 | Post | 42/51 |
| 6,073,380 | A * | 6/2000 | Hauser et al. | 42/70.06 |
| 6,276,354 | B1 * | 8/2001 | Dillon | 124/74 |
| 6,978,568 | B2 * | 12/2005 | Jewell | 42/69.02 |
| 7,100,592 | B1 * | 9/2006 | Yang | 124/67 |
| 7,331,136 | B2 * | 2/2008 | Geissele | 42/69.03 |
| 7,516,570 | B2 * | 4/2009 | Stone | 42/69.01 |
| 7,726,230 | B1 * | 6/2010 | Erdem | 89/184 |
| 2003/0106545 | A1 * | 6/2003 | Verini | 124/74 |

FOREIGN PATENT DOCUMENTS

EP 122220 A1 * 10/1984

* cited by examiner

*Primary Examiner* — Loan Thanh
*Assistant Examiner* — Daniel F Roland
(74) *Attorney, Agent, or Firm* — Jonathan Rigdon Smith P.C.; Jonathan R. Smith

(57) ABSTRACT

A finger strengthening device is a simulated handgun fitted with an adjustable spring-loaded trigger mechanism. The handgun simulation is selected to match the model of gun to be used, and the exertion required to pull the trigger is initially set at the maximum resistance the shooter can achieve with a steady pull and aim. A method or regimen for proper strengthening is included.

3 Claims, 5 Drawing Sheets

TRIGGER FINGER STRENGTHENING APPARATUS AND METHOD

FIELD OF INVENTION

This invention relates to the field of firearm training, more specifically to handgun training.

BACKGROUND OF INVENTION

Key elements in accurate shooting, especially handgun shooting, are steady aim and steady trigger pull. If a person has difficulty pulling a trigger due to inadequate finger pull strength, either the trigger cannot be pulled completely at all, or the hand and arm may shake due to the required effort. Thus, either the weapon cannot be fired or the aim cannot be well maintained. Furthermore, the pull of the trigger may be jerky and the timing of the shot may be unpredictable.

Handgun grips are shaped so as to utilize the forefinger to pull the trigger. This finger is nearest to the trigger and frees the (ordinarily) stronger middle finger for a good grip on the gun. If a shooter has difficulty pulling the trigger with his or her forefinger, he or she may try to use the middle finger instead. This is not recommended in a one-handed shot because the grip is left to the two remaining, usually weaker, fingers.

Inadequate forefinger strength combined with sudden or initial use of a firearm can also lead to injury, which further delays firearm training. Sometimes people learn they have inadequate forefinger strength when they first attempt to fire a handgun, or first fire a handgun notable for hard trigger pull such as a large caliber uncocked revolver. This can result in a type of injury known as "trigger finger," wherein the tendons of the forefinger on top of the hand are strained.

To solve the problem of inadequate forefinger strength, affected handgun users may exercise the grip using common grip-strengthening devices such as spring-loaded hand grips. This strengthens the entire grip and all fingers acting in concert but does not strengthen the forefinger per se, especially in the grip configuration in which the flexor muscle of the forefinger is extended while the others are contracted.

BRIEF DESCRIPTION OF THE INVENTION

This invention is a simulated handgun fitted with an adjustable spring-loaded trigger mechanism. The handgun simulation is selected to match the model of gun to be used, and the exertion required to pull the trigger is initially set at the maximum resistance the shooter can achieve with a steady pull and aim. The shooter then squeezes the trigger of the invention on a regimen to build the strength of the forefinger until that setting becomes easy. The trigger pull resistance is then reset to a higher level, and the process is repeated until the actual trigger pull of the desired weapon is reached and becomes sufficiently manageable to the user.

The principal object of this invention is thus to permit a shooter to strengthen his or her trigger pull with a simulator that precisely mimics the characteristics of a weapon of choice. Another object of the invention is to prevent forefinger injury due to sudden over-exertion in a firearm use situation. A further object of the invention is to provide a trigger finger strengthening apparatus that can be adjusted to provide variable strength settings. Yet another object of the invention is to provide a method or regimen for strengthening a trigger finger that minimizes the risk of injury and maximizes the rate of strengthening.

DETAILED DESCRIPTION OF THE INVENTION

Figure 1:
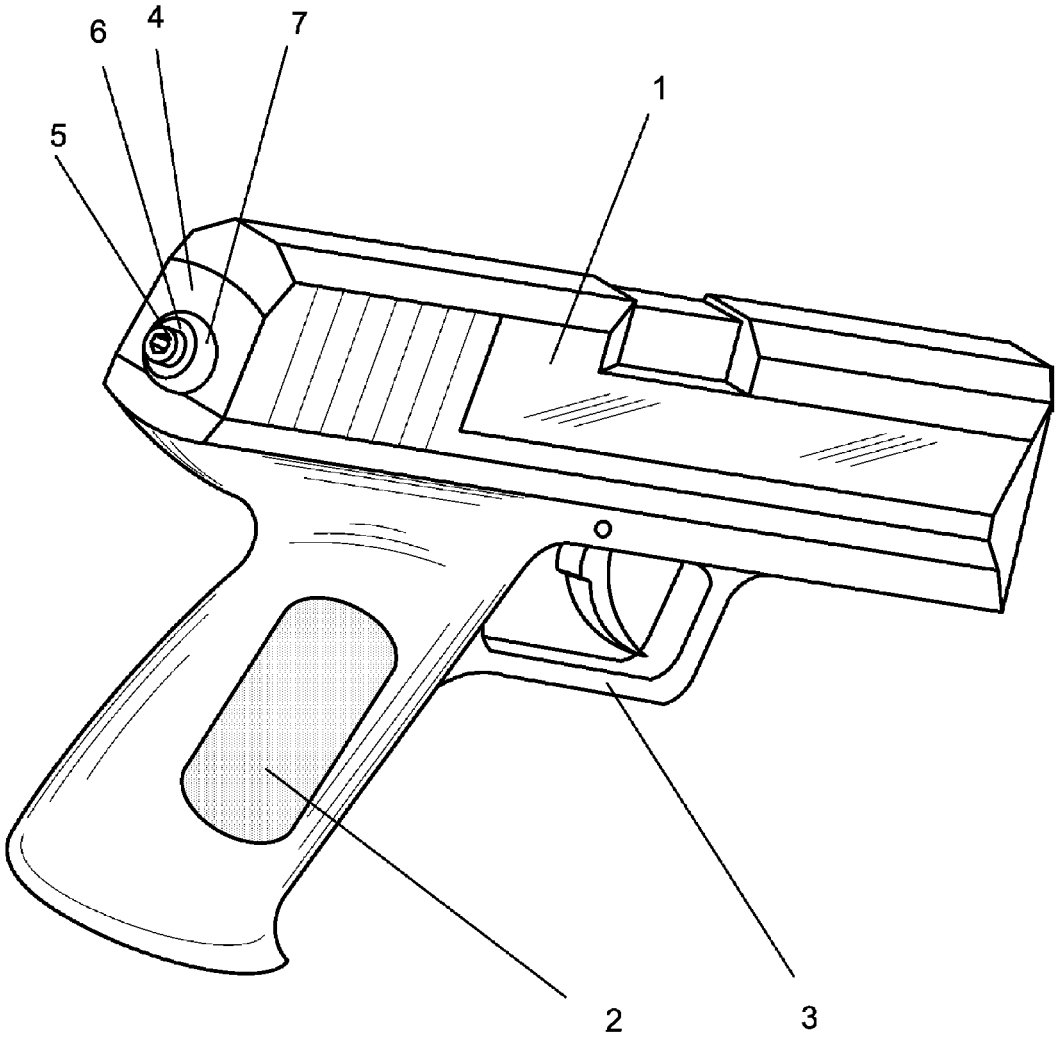
FIG. 1 is a perspective view of the principal embodiment of the invention.

The following is a detailed description of the invention in which like reference characters in the text of this specification refer to like elements in all of the drawings.

FIG. 1 is a perspective view of the principal embodiment of the invention. It shows a simulation of a gun 1 in which the shape of the grip 2 and the placement of the trigger guard 3 are a true ergonomic replica of the firearm of choice. This is to assure that the positions of all of the parts of the shooter's hand relative to each other is exactly the same during strengthening exercises as they are when attempting to fire the weapon of choice. Preferably even the weight of the simulation is identical or nearly so to the weight of the actual weapon.

The only outward difference in appearance between the invention and a corresponding real firearm is on the rear end 4 of the gun, where an adjustment knob 5, washer 6, and bezel 7 can be seen.

Figure 2:
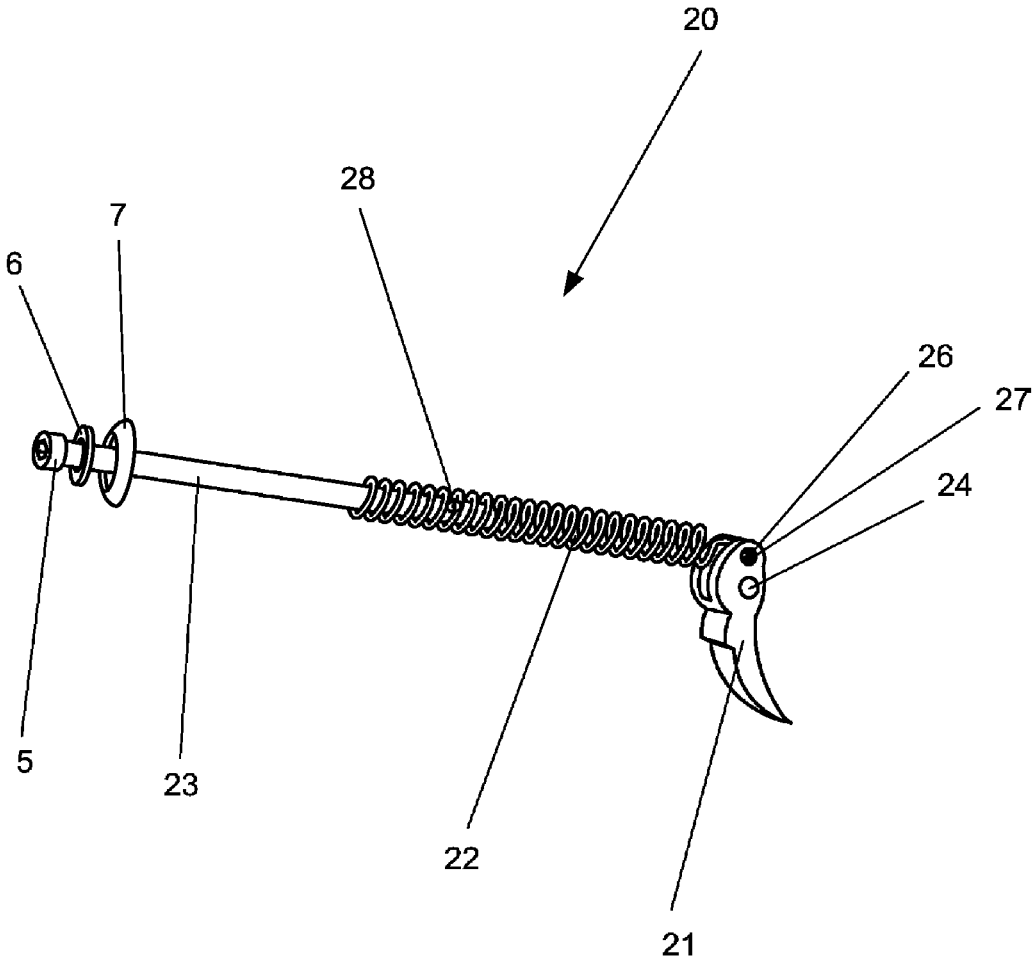
FIG. 2 is a perspective view of the trigger pull subassembly of the principal embodiment.

FIG. 2 is a perspective view of the trigger pull subassembly 20. It comprises a trigger 21, a spring 22, an adjustment screw 23, a trigger fulcrum hole 24, a trigger spring clevis hole 26, and a spring clevis pin 27, along with washer 6 and bezel 7. Note further that adjustment screw 23 has an Allen head adjustment knob 5 and a sidewards-projecting knob 28 that engages spring 22 between turns.

Figure 3:
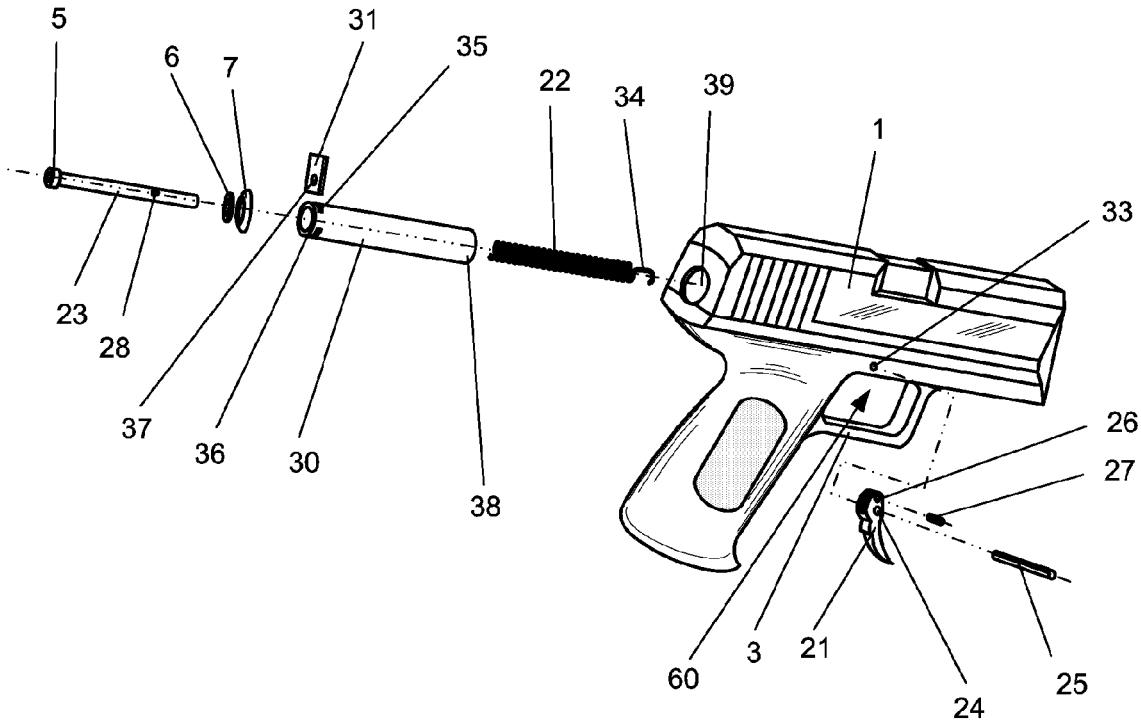
FIG. 3 is a perspective exploded view of the principal embodiment of the invention.

FIG. 3 is a perspective exploded view of the principal embodiment of the invention, showing how it is assembled. In addition to the parts listed so far, the invention further comprises a spring sleeve 30 and safety plate 31. Safety plate 31 is first installed into vertical slot 35 near the rear end 36 of spring sleeve 30. Washer 6 and bezel 7 are then slid onto adjustment screw 23, and screw 23 is then slid into safety plate hole 37. Spring clevis pin 27 is then pushed into the clevis hole 26 at the top of trigger 21. Adjustment screw 23 is then started onto spring 22 by rotating it until knob 28 catches within the turns of the spring 22. Then, forward end 34 of the spring 22 is connected to the spring clevis pin 27. Next, all of these parts as assembled are inserted trigger first into gun 1 through rear port 39 of gun 1 until trigger 21 emerges inside trigger guard 3 through trigger slot 60 (out of sight in this view below gun fulcrum hole 33). The trigger 21 is then fastened into place by pushing fulcrum pin 25 through gun fulcrum hole 33 and through trigger fulcrum hole 24.

As screw 23 is advanced into spring 22 by turning adjustment knob 5, it pulls the entire sleeve 30 fully into the gun until safety plate 31 contacts the rear surface of the gun 1. Once that happens, continued turning of the knob 5 increases tension on the trigger 21. Adjustment knob 5 is here depicted as an Allen head, but any currently known means of turning adjustment knob 5 falls within the scope of this invention without limitation.

Depicted in these figures is a simulation of a Heckler & Koch P-2000 semiautomatic handgun, although the scope of this invention extends to any gun, including long guns. The preferred embodiment utilizes an Allen head adjustment screw for knob 5 to enable the trigger tension to be set at virtually any strength, and the adjusted strength cannot be changed inadvertently. The strength can be measured and set with any of a variety of tension gauges. The small knob 5 is desirable also if strict adherence to the shape of the actual firearm is important, such as when the gun must fit precisely under the strap of a holster.

An alternative, second, embodiment of this invention (not shown) includes pre-setting the tension at the same tension nominally existing on the chosen weapon, which in this example would be that of a Heckler & Koch P-2000.

Figure 4:
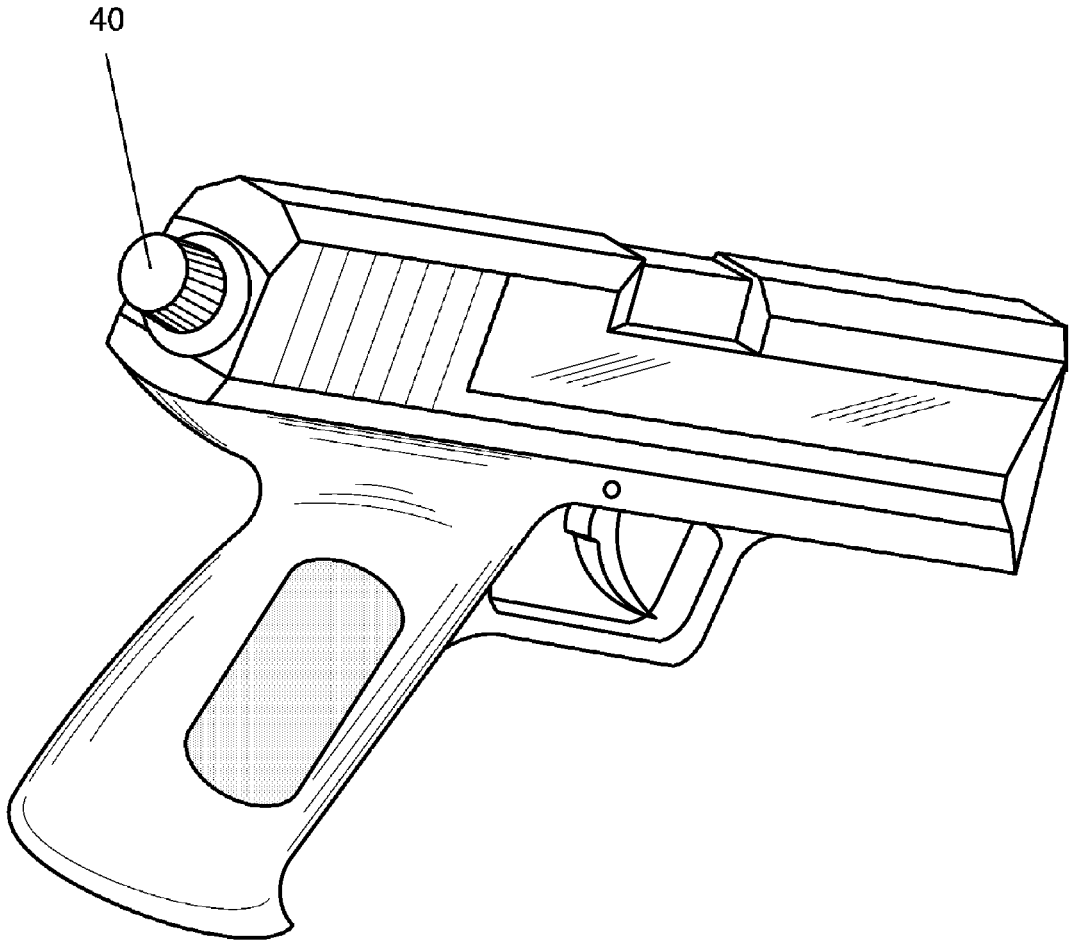
FIG. 4 is a perspective view of a third embodiment of the invention.

FIG. 4 is a perspective view of yet another, third, embodiment of the invention. It provides a larger knurled knob 40 that can be turned with hand rotation and set with a tension gauge.

A fourth embodiment of this invention (not shown) provides a knurled knob that can be set at three strength settings: first, a strength below the normal tension of the real weapon as a starting tension for the trainee; second, the actual tension of the real weapon; and third, a level somewhat above that of the real weapon to help maintain the necessary trigger finger strength.

Figure 5:
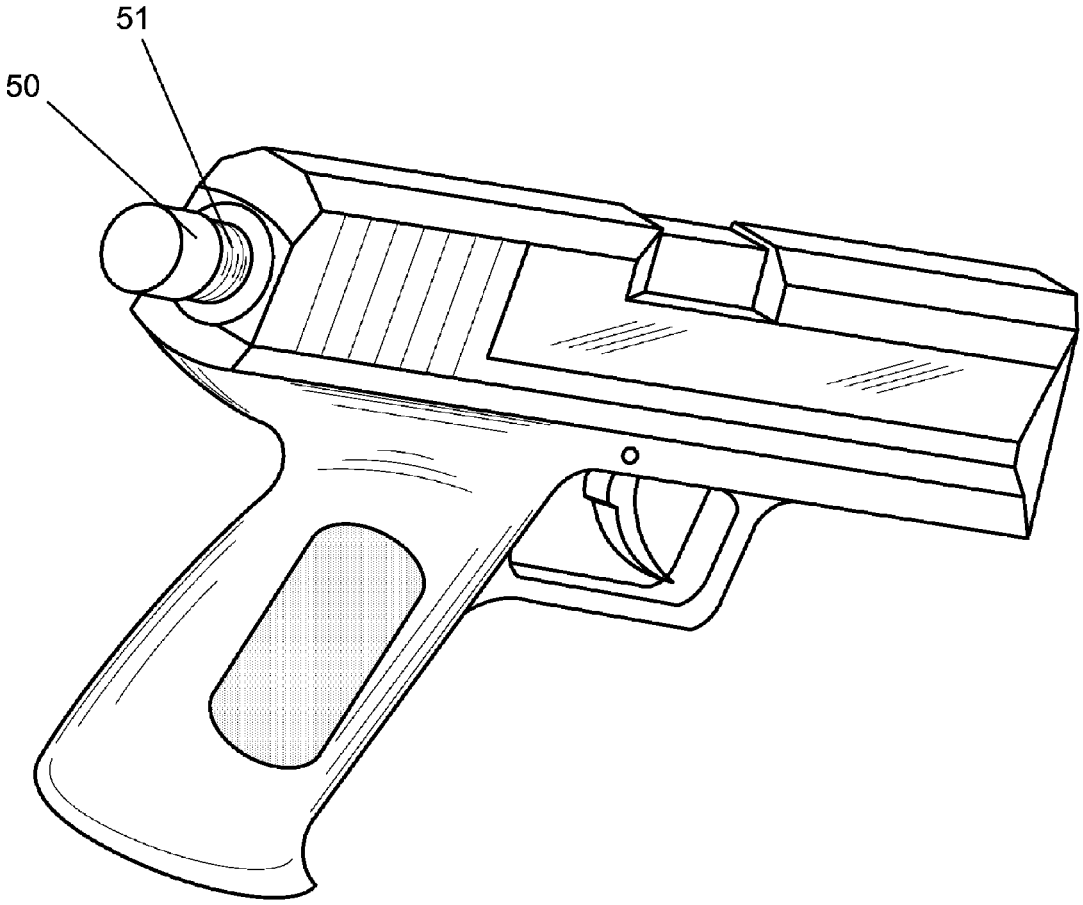
FIG. 5 is a perspective view of a fifth embodiment of the invention.

FIG. 5 is a perspective view of a fifth embodiment of the invention in which the simulated gun is more generic in appearance, and a vernier apparatus 50 enables the user to "dial in" any one of a variety of gun trigger tensions, denoted on scribed indices 51, either in pounds or newtons of force, or by the model of the gun for which finger strength training is desired.

This invention also encompasses a method for use in training. Proper technique to train with the device to achieve maximum effectiveness is to work the weapon at arms length with a normal two-handed shooting grip, keeping the sights properly aligned as the trigger is manipulated. This isolates the muscle that pulls the trigger. The right and left trigger fingers should be alternated to strengthen whichever is weaker. Repetitions should be ten to twenty trigger pulls with one hand, then swap hands. A single training session should be no longer than ten minutes or fatigue will set in and the training then becomes counterproductive. Two or three such sessions can be done per day, preferably with an hour in between.

Proper drawing of the device can be incorporated into the training session, in which case the exercise begins with the invention snapped into a holster, as typically required of a real weapon in accordance with safety policy. As the invention is drawn and presented to the threat/target area, the trigger is started before full extension of the arms is achieved then as the sights are being properly aligned, the trigger is pulled fully to the rear. This type of repetition is as beneficial as just pulling the trigger to build strength, and adds practice with proper draw, presentation to threat, and shot sequence.

I claim:

1. A trigger finger strengthening apparatus, comprising:

a substantially horizontal portion simulating the chamber and barrel of a gun;

the horizontal portion having a rear end and a muzzle end;

a substantially vertical portion simulating the grip of a gun, affixed to and depending from the horizontal portion;

a trigger having an upper end, a pivot point, and a lower end;

a substantially horizontal elongate rear port hollowed out of the rear end and extending toward the muzzle end;

a spring disposed within the rear port having a first end and a second end;

the first end being attached to the rear end, the second end being attached to the upper end and applying a bias thereto;

the spring being helical with a plurality of spaces between flights;

a substantially vertical plate mounted on the rear end, the plate having a hole therethrough communicating with the rear port;

a screw having a forward end and a rearward end, the rearward end having a rotatable head extending rearwardly of the plate, the forward end extending into the rear port and having a sideward-projecting knob that protrudes from the screw into one of the plurality of spaces between flights;

the screw increasing the bias when the head is rotated in one direction and decreasing the bias when the head is rotated in the opposite direction.

2. The apparatus of claim 1, further comprising:

a hollow spring tube affixed to said plate, extending into said rear port, and surrounding said spring.

3. The apparatus of claim 2, in which:

a bezel is interposed between said head and said plate; and a washer is interposed between said head and the bezel.

* * * * *